US008479611B2

(12) United States Patent
Federighi

(10) Patent No.: US 8,479,611 B2
(45) Date of Patent: Jul. 9, 2013

(54) CORKSCREW WITH UNIDIRECTIONAL CLUTCH DRIVE

(76) Inventor: William David Federighi, Novato, CA (US)

( * ) Notice: Subject to any disclaimer, the term of this patent is extended or adjusted under 35 U.S.C. 154(b) by 490 days.

(21) Appl. No.: 12/799,122

(22) Filed: Apr. 19, 2010

(65) Prior Publication Data

US 2011/0252924 A1 Oct. 20, 2011

(51) Int. Cl.
*B67B 7/00* (2006.01)

(52) U.S. Cl.
USPC ..... 81/3.45; 81/3.47; 192/41 S

(58) Field of Classification Search
USPC ..... 81/3.45, 3.36, 3.33, 3.35, 3.37, 3.47, 81/3.48; 192/30 R, 41 S, 81 C
See application file for complete search history.

(56) References Cited

U.S. PATENT DOCUMENTS 3,477,486 A * 11/1969 Modrey ..... 81/58
4,143,693 A * 3/1979 Acevedo ..... 81/28
4,235,133 A * 11/1980 Acevedo ..... 81/58
4,341,293 A * 7/1982 Acevedo ..... 192/43
5,454,282 A * 10/1995 Del Mistro ..... 81/3.48

* cited by examiner

*Primary Examiner* — Alicia Torres
(74) *Attorney, Agent, or Firm* — Howard Cohen

(57) ABSTRACT

An improved corkscrew includes a unidirectional clutch mechanism that enables the user to grasp the corkscrew handle, place the screw tip impinging on the cork, and to rotate the handle reciprocally to advance the screw unidirectionally and embed it in the cork. The mechanism features a clutch spring that transfers rotation of the handle to the screw in one direction only, and rotates freely in the opposite direction.

12 Claims, 2 Drawing Sheets

CORKSCREW WITH UNIDIRECTIONAL CLUTCH DRIVE

CROSS-REFERENCE TO RELATED APPLICATIONS

Not applicable.

FEDERALLY SPONSORED-RESEARCH

Not applicable.

SEQUENCE LISTING, ETC ON CD

Not applicable.

BACKGROUND OF THE INVENTION

1. Field of the Invention

This invention relates to corkscrews for removing a cork from a wine bottle or the like and, more particularly, to corkscrews that minimize manual effort and fatigue.

2. Description of Related Art

The practice of sealing a bottle with a cylindrical cork has been known for many centuries, and requires that the cork driven into the neck of the bottle in an interference fit must be removed to gain access to the comestible liquid stored within. The simplest tool for removing a cork has been a helical corkscrew, which may be threaded into the soft cork material to gain purchase therein, after which the corkscrew may be pulled coaxially from the bottle neck to free the cork therefrom.

Typically the basic corkscrew is provided with a T-shaped handle to enable a user to grasp the corkscrew so that it may be rotated and threaded into the cork, and to permit a firm grip for pulling the cork out of the bottle. A simple rod or dowel extending diametrically at the outer end of the screw will suffice for these purposes. This simple handle does not provide any mechanical advantage for these tasks, and for those individuals who lack manual dexterity or manual strength, the simple handle is difficult to use effectively. And for those who must remove many corks daily, such as waiters or sommeliers, the repetitive twisting motion to embed the screw in the cork and the pulling gesture to remove the cork may cause repetitive stress injuries to the hands and wrists.

An improved corkscrew known commonly in the art provides a handle from which the helical screw depends from a hinge-like pivot, so that the screw and its sharp tip may be covered and protected by the handle when not in use. The handle is also provided with a folding link that has a distal tip used to engage the lip of the bottle opening after the screw is driven into the cork. The link acts as a fulcrum, and the handle as a lever that creates a substantial mechanical advantage to pull the cork from the bottle opening. This design alleviates much of the manual work required to release the cork from the bottle.

However, there is no effective mechanism known in the prior art for reducing the manual effort required to drive the screw into the cork. That is, once the corkscrew handle is rotated approximately one-half turn to engage the screw tip, the user must release the grip, turn the hand to its unrotated position, re-grasp the handle, and rotate it through another one-half turn to advance the screw. This process must be repeated several times before the screw is sufficiently embedded in the cork so that it may be pulled out successfully. The twisting and re-grasping motions are particularly fatiguing to the hand and wrist. There is a need in the prior art for a better mechanism for accomplishing this portion of the task with greater ease and less effort.

BRIEF SUMMARY OF THE INVENTION

The present invention generally comprises a corkscrew that greatly eases the cork removal process. The key feature of the invention is a mechanism that enables the user to grasp the corkscrew handle, place the screw tip impinging on the cork, and to rotate the handle repeatedly to advance the screw and embed it in the cork. The mechanism provides a unidirectional clutch action that enables the user to carry out multiple rotations of the screw without releasing the handle, thereby greatly simplifying the task and reducing the effort required to embed the screw in the cork. As a result, fatigue of the user's hand and wrist is substantially reduced, and repetitive stress injuries are diminished.

The unidirectional clutch mechanism of the invention includes a tubular housing provided with diametrically opposed holes at a proximal end to receive a pivot pin anchored in the corkscrew handle. The distal end of the housing has a closed end with a circular opening disposed coaxially therein. A hex bushing is received within the distal end of the housing, and is provided with a central hex opening extending axially therethrough. The hex bushing is provided with a distal flange that defines a first annular space between the hex bushing and the interior surface of the housing.

A helical screw includes a distal sharp end for piercing a cork, and a distal end that is secured in an axially extending socket of a hex pin. The proximal end of the hex pin extends through the circular opening of the housing and through the central hex opening of the hex bushing. Thus the screw is joined for motion in common with the hex bushing. Also secured in the housing is a drive bushing which has a circular central opening through which passes the proximal end of the hex pin in freely rotating fashion. The drive bushing includes a distal neck portion that defines a second annular space between the distal end of the drive bushing and the interior surface of the housing. The first and second annular spaces are axially adjacent and define together a contiguous annular space. A drive pin extends through a diametrical hole in the proximal end of the hex pin to secure the assembly of the housing, hex pin, hex bushing, and drive bushing. The pivot pin also extends through diametrically opposed holes in the proximal end of the drive bushing, so that the housing and drive bushing are joined for rotation in common.

A helical clutch spring is disposed within the contiguous annular space. The clutch spring, which is a left-hand helix, provides the only rotational connection between the drive bushing and the hex bushing.

When the corkscrew handle is rotated, the housing and the drive bushing rotate therewith due to the pivot pin linking them together. The hex bushing and the screw, however, are rotationally linked to the housing only by the clutch spring. Thus, when the handle is rotated in a clockwise direction, the clutch spring proximal end is rotated by the frictional contact of the drive bushing, causing the clutch spring to tighten about the hex bushing and to apply torque to the hex bushing. This action causes the screw to rotate clockwise, advancing the screw into a bottle cork. However, when the handle is rotated counterclockwise, the drive bushing rotates the clutch counterclockwise, causing the spring to loosen about the hex bushing and applying no torque to the hex bushing. Thus the handle does not rotate the screw counterclockwise. The net result of these component interactions is that the handle may be cranked back and forth clockwise and counterclockwise, and the screw will only rotate in the clockwise direction to advance into the cork. Thus the user may twist the handle clockwise and counterclockwise without releasing the grip on the handle, and the screw will embed itself in the cork.

DETAILED DESCRIPTION OF THE INVENTION

Figure 1:
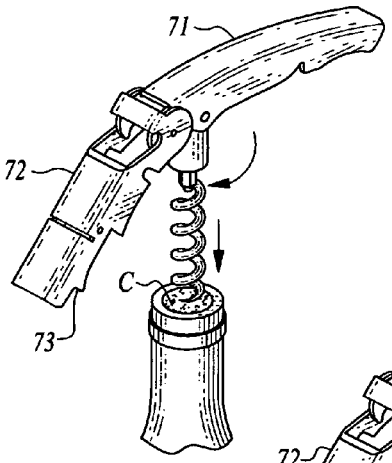
FIGS. 1-4 are a sequence of perspective views showing the corkscrew of the invention as it is rotated and threaded into the cork lodged in a bottle.

The present invention generally comprises a corkscrew that greatly eases the cork removal process by enabling the user to grasp the corkscrew handle and rotate the handle repeatedly and reciprocally without releasing the handle to advance the screw and embed it in the cork. The corkscrew's unidirectional clutch action enables the user to carry out multiple rotations of the screw without releasing the handle, thereby greatly simplifying the task and reducing the effort required to embed the screw in the cork.

With regard to FIGS. 6 and 10-12, the unidirectional clutch mechanism includes a tubular housing 21 having an open proximal end and a pair of diametrically opposed holes 22 disposed adjacent thereto. The distal end of the housing 21 is closed by end wall 23, and a circular opening 24 is disposed coaxially in the end wall 23. A hex bushing 26 is received within the distal end of the housing 21, and it is provided with a flange 27 that abuts the interior surface of the housing. As a result, the hex bushing defines a first annular space 28 between the hex bushing and the interior surface of housing 21. The hex bushing also includes an axially extending bore 29 therethrough that is provided with a hexagonal conformation, as shown best in FIG. 12.

The unidirectional clutch mechanism also includes a helical screw 31 having a sharpened distal tip for penetrating a cork, and a distal end shank that is coaxial with the housing 21. A hexagonal pin 32 includes an axially disposed socket 33 that receives the distal shank of the screw 31 and is permanently secured therein. The hex pin 32 extends through the circular opening 24 of the housing 21 and into the bore 29 of the hex bushing, where it is permanently secured. The opening 24 is dimensioned to permit rotation of the hex pin 32 therein, and the hex bushing is joined for rotation in common with the helical screw 31.

The unidirectional clutch mechanism further includes a drive bushing 41 which has a proximal tubular portion 42 dimensioned to be received in the housing 21. A pair of diametrically opposed holes 43 are located in the portion 42 and positioned to align with holes 22 of the housing, as will be detailed below. The drive bushing also includes a distal portion 44 having a reduced diameter that defines with the interior surface of the housing a second annular space 48 that is contiguous with the first annular space 28. The distal portion 44 includes a central bore 4 that is dimensioned to receive the hex pin 32 therethrough in freely rotating fashion.

The hex pin 32 includes a diametrical hole 51 adjacent to its proximal end, and the distal end of portion 42 of the drive bushing is provided with a pair of diametrically opposed holes 49. A drive pin 52 is secured in the hole 51 of the hex pin, with access thereto provided by holes 49 in the drive bushing. Thus the pin 52 serves to retain the assembly of the housing, hex pin 32, hex bushing 26, and drive bushing 41. Furthermore, a pivot pin 63 extends through the aligned holes 22 and 43 of the housing 21 and drive bushing 41, securing those components together, as shown in FIG. 5.

Secured within the contiguous annular space 28 and 48 is a helical clutch spring 54, which is a left-handed helix. The clutch spring is formed of wire having flat exterior and interior surfaces as is known in the prior art. Due to the fact that the hex bushing and drive bushing are not otherwise coupled in rotation, the clutch spring 54 provides the only rotational connection between the drive bushing and the hex bushing and thus the helical screw.

Figure 5:
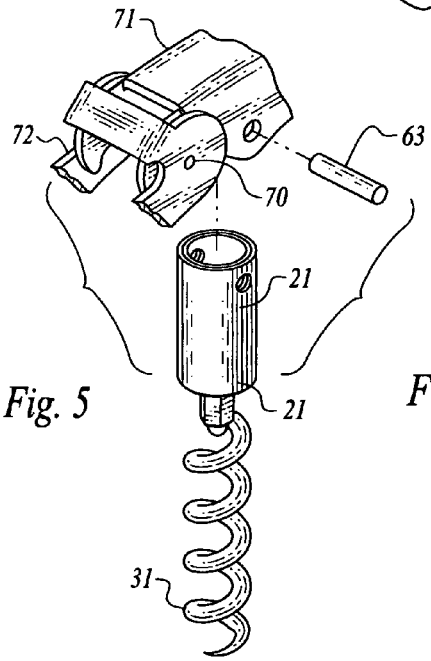
FIG. 5 is a partial exploded view of the corkscrew and unidirectional clutch mechanism of the invention joined to the corkscrew folding handle.
Figure 6:
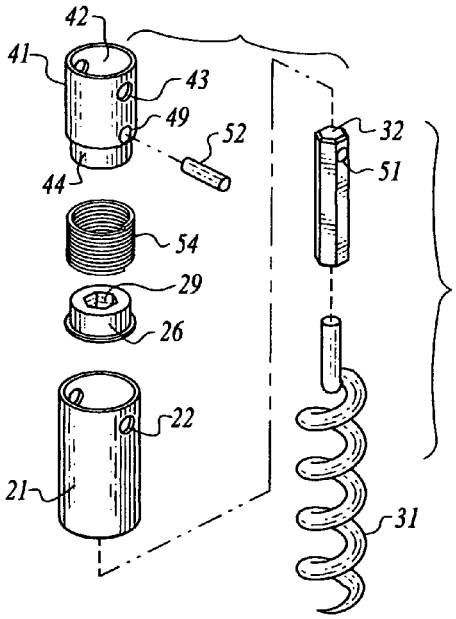
FIG. 6 is an exploded view of the corkscrew and unidirectional clutch mechanism of the invention.

With regard to FIG. 1, for example, the corkscrew assembly includes a handle 71 and an arm 72 pivotally secured to the handle at hinge 70 (FIG. 5). The arm includes a distal flange or inset 73 that is configured to engage the lip of a bottle opening. The pivot pin 63 not only extends through the housing 21 and drive bushing 41, it also extends through aligned holes 74 in the handle 71, whereby the unidirectional clutch mechanism described above is pivotally secured to the handle and may be rotated so that the helical screw 31 is impinged on the handle and stored in a protected space therein. Moreover, when the screw 31 has been threaded into a cork and the inset 73 is resting on the lip of the bottle, the handle may be lifted to remove the cork. There is a significant mechanical advantage equal to the ratio of the distance of the point of uplift from the hinge 70, divided by the distance between the pivot pin 63 and the hinge 70. This leverage enables and eases removal of the cork from the bottle without undue effort.

Figure 7:
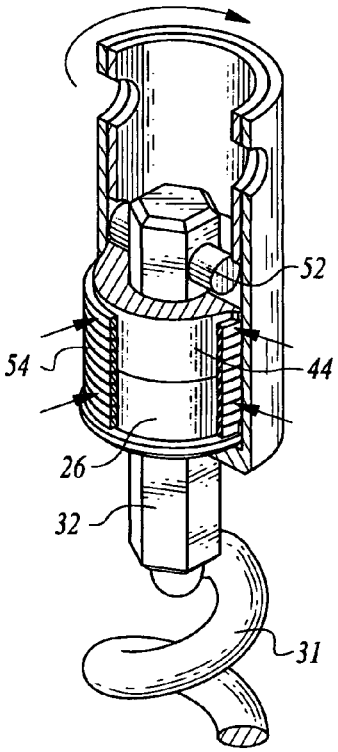
FIGS. 7-9 are a sequence of enlarged, partially cross-sectioned perspective views of the unidirectional clutch mechanism of the invention, depicting the unidirectional rotational action of the unidirectional clutch mechanism.
Figure 8:
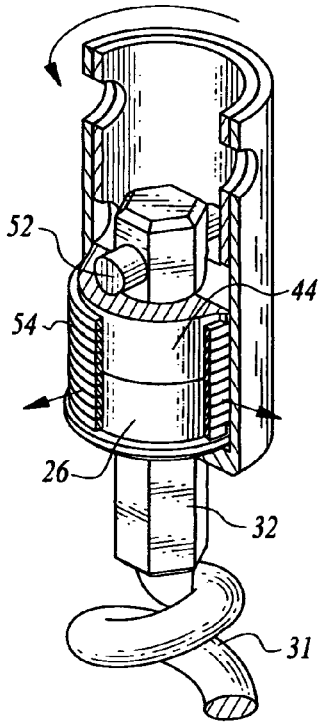
Figure 9:
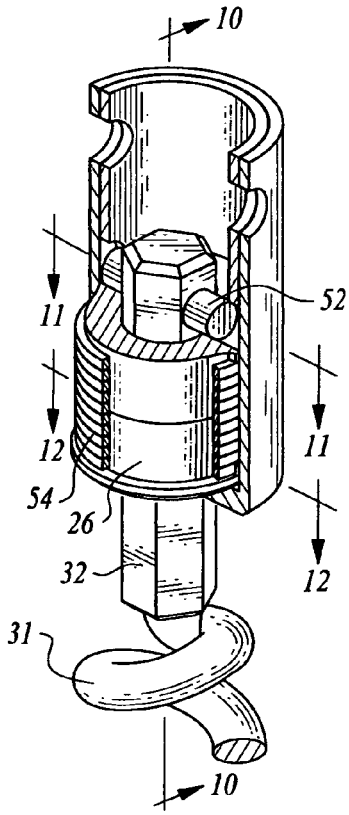
Figure 10:
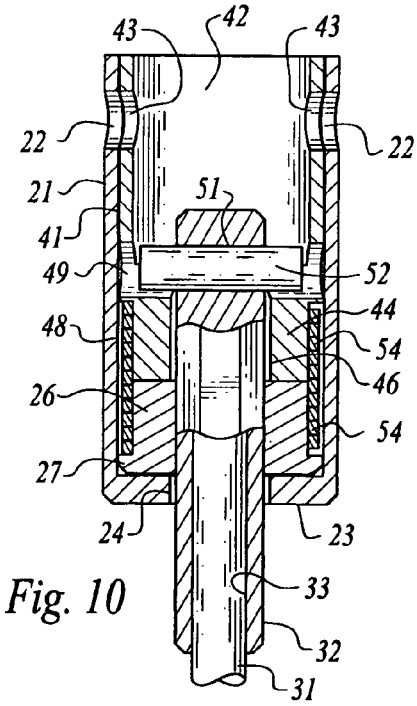
FIG. 10 is a cross-sectional elevation of the unidirectional clutch mechanism, taken along line 10-10 of FIG. 9.
Figure 11:
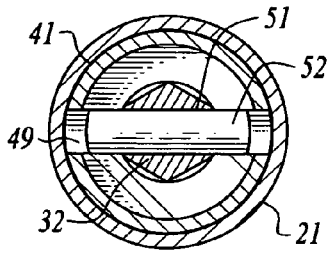
FIG. 11 is a cross-sectional view of the unidirectional clutch mechanism, taken along line 11-11 of FIG. 9.
Figure 12:
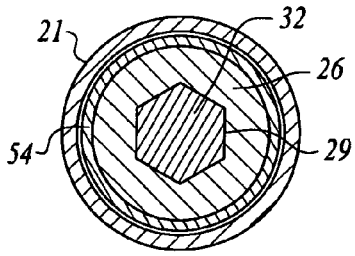
FIG. 12 is a cross-sectional view of the unidirectional clutch mechanism, taken along line 12-12 of FIG. 9.

The operation of the invention is illustrated in the sequential views of the unidirectional clutch mechanism of FIGS. 7-9, taken together with the sequential views of FIGS. 1-4. As shown in FIG. 1, the cork removal process is initiated by unfolding the arm 72 from the handle 71 to deploy the helical screw 31 and to establish a T-shaped handle formed by the components 71 and 72 and manually grasped by the user. The sharp tip of the screw 31 is placed in contact with the cork C, and the user presses the handle toward the cork while rotating the handle clockwise. As shown in FIG. 7, the clockwise rotation of the handle causes the housing 21 and drive bushing 41 to be rotated clockwise by the pivot pin 63. The clockwise rotation is applied by frictional contact of the neck portion 44 on the clutch spring, and the flat exterior and interior surfaces of the clutch spring enhance the frictional contact. Due to the left-handedness of the spring 54, it contracts radially and forms a rotational link between the neck portion 44 of the drive bushing and the hex bushing 26. The hex bushing thus is also rotated clockwise, driving the helical screw 31 clockwise to thread its way into the cork.

Figure 2:
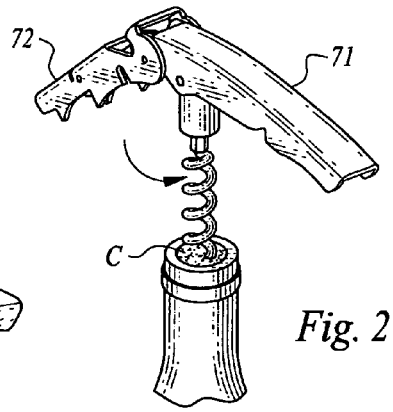
Figure 3:
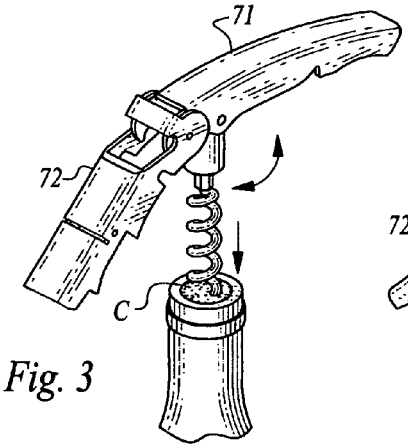
Figure 4:
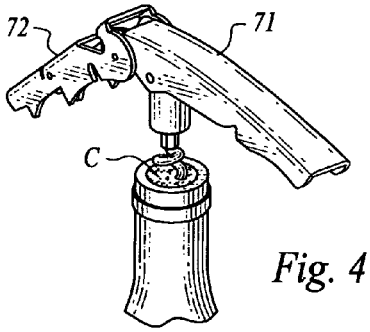

When the user's hand has traveled its full extent in the clockwise direction, the user maintains the same grip on the handle 71 and arm 72 and rotates them counterclockwise, as shown in FIG. 2. The frictional contact of the drive bushing neck portion 44 on the clutch spring 54 reverses, causing the clutch spring to expand radially (FIG. 8) and relax its rotational grip on the hex bushing. Thus no counterclockwise rotational moment is applied to the helical screw 31, even though the handle is being rotated counterclockwise. Therefore the screw 31 does not turn in this phase of the process. The handle is then rotated reciprocally clockwise and counterclockwise a few more times (FIG. 3) until the helical screw 31 is embedded in the cork (FIG. 4). Thereafter the arm 72 and handle 71 are utilized to remove the cork C from the bottle, as described previously.

Note that in this entire process the user need not release and re-grip the corkscrew. This fact not only results in greatly diminished stress to the hand and wrist, it also simplifies the task of the threading of the screw 31 into the cork. In addition, the user may reciprocate the handle of the corkscrew through a smaller angle than typically used with prior art devices, and the small angle excursions may be carried out quickly and efficiently, further reducing the manual fatigue factor.

Although the invention has been described with reference to the use of a hex pin and hex bushing to apply rotational drive to the helical screw, it may be appreciated that any regular or irregular polygonal shape may be employed in like fashion for this purpose. Likewise, the right-handedness helical screw together with the left-handedness of the clutch spring may be transposed without exceeding the bounds of this invention. Furthermore, the handle construction shown herein is for exemplary purposes only; other handle configurations known in the prior art may be employed with the unidirectional rotation mechanism of the invention.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. In a corkscrew having a handle operatively associated with a helical screw for threadingly engaging a cork, the improvement comprising:

unidirectional rotation means for rotating the helical screw to thread into the cork;

first attachment means for securing said unidirectional rotation means to the handle;

second attachment means for securing said unidirectional rotation means to the helical screw;

said unidirectional rotation means including a tubular housing having a proximal end adjacent to the handle and secured thereto;

the helical screw including a proximal end having a shank, and said unidirectional rotation means including a hex pin having a receptacle disposed coaxially in the distal end thereof to secure the shank;

said tubular housing including a distal opening for receiving said hex pin therein; and, a hex bushing disposed for free rotation in a distal portion of said tubular housing, said hex bushing includes a central bore extending coaxially therethrough and having a hex configuration to receive said hex pin therethrough in rotation-transferring manner therebetween.

2. The corkscrew of claim 1, wherein said hex bushing defines a first annular space between the exterior surface of said hex bushing and the adjacent interior surface of said tubular housing.

3. The corkscrew of claim 2, further including a drive bushing disposed in a proximal portion of said tubular housing for rotation in common therewith.

4. The corkscrew of claim 3, wherein said drive bushing includes a distal portion adjacent to said hex bushing, said distal portion of said drive bushing defining a second annular space between the exterior surface of said distal portion of said drive bushing and the adjacent interior surface of said tubular housing.

5. The corkscrew of claim 4, wherein said first and second annular spaces define a contiguous annular space.

6. The corkscrew of claim 5, further including a clutch spring disposed in said contiguous annular space, said clutch spring being rotatable by frictional engagement of said distal portion of said drive bushing in a first rotational direction to tighten about said hex bushing and impart rotation thereto in said first rotational direction, and said clutch spring being rotatable by frictional engagement of said distal portion of said drive bushing in a second rotational direction to loosen about said hex bushing and not impart rotation thereto in said second rotational direction.

7. The corkscrew of claim 6, wherein the helical screw has a right-handed thread, and said first rotational direction is similarly right-handed.

8. The corkscrew of claim 4, further including a bore extending in said distal portion of said drive bushing to receive a proximal end of said hex pin therethrough in freely rotating fashion, a diametrical hole in a proximal end of said hex pin; and, a drive pin extending through said diametrical hole to join said hex pin, hex bushing, and drive bushing in an assembly.

9. The corkscrew of claim 3, further including a first pair of mounting holes extending diametrically in a proximal portion of said tubular housing, a second pair of mounting holes extending in a proximal portion of said drive bushing, and a pivot pin extending through said first and second mounting holes.

10. The corkscrew of claim 9, wherein said pivot pin extends through a portion of the handle and comprises said first means for securing said unidirectional rotation means to the handle.

11. The corkscrew of claim 1, wherein said unidirectional rotation means includes a clutch spring coupled between said first attachment means and said second attachment means.

12. The corkscrew of claim 11, wherein said first attachment means and said second attachment means defines an annular space for receiving said clutch spring therein.

* * * * *